US007344150B2

(12) United States Patent
Poellmann

(10) Patent No.: US 7,344,150 B2
(45) Date of Patent: Mar. 18, 2008

(54) SLIDING BOARD, IN PARTICULAR SKI

(75) Inventor: Edgar Poellmann, Vienna (AT)

(73) Assignee: Tyrolia Technology GmbH, Schwechat (AT)

( * ) Notice: Subject to any disclaimer, the term of this patent is extended or adjusted under 35 U.S.C. 154(b) by 188 days.

(21) Appl. No.: 11/050,413

(22) Filed: Feb. 3, 2005

(65) Prior Publication Data

US 2005/0212260 A1 Sep. 29, 2005

(30) Foreign Application Priority Data

Feb. 11, 2004 (AT) ..... 101/2004 U

(51) Int. Cl.
*A63C 5/00* (2006.01)

(52) U.S. Cl. ..... 280/607; 280/610

(58) Field of Classification Search ..... 280/610, 280/607

See application file for complete search history.

(56) References Cited

U.S. PATENT DOCUMENTS

| | | | | |
|---|---|---|---|---|
| 3,915,466 | A * | 10/1975 | Matsuda | 280/617 |
| 5,435,589 | A * | 7/1995 | Fagot | 280/610 |
| 6,641,162 | B2 * | 11/2003 | Allmann et al. | 280/607 |
| 7,011,331 | B2 * | 3/2006 | Riepler | 280/601 |
| 2002/0121764 | A1 * | 9/2002 | Kruajitch | 280/607 |
| 2003/0102651 | A1 * | 6/2003 | Riepler | 280/610 |
| 2004/0108687 | A1 * | 6/2004 | Schretter | 280/607 |

FOREIGN PATENT DOCUMENTS

| | | | |
|---|---|---|---|
| AT | 336 460 | B | 5/1977 |
| EP | 1 161 972 | A2 | 12/2001 |
| FR | 2 704 155 | A1 | 10/1994 |
| WO | WO 01/45810 | A1 | 6/2001 |

OTHER PUBLICATIONS

Austrian Patent Office Search Report dated Dec. 3, 2004 (2 pages).

* cited by examiner

*Primary Examiner*—Christopher P. Ellis
*Assistant Examiner*—John R. Olszewski
(74) *Attorney, Agent, or Firm*—Flynn, Thiel, Boutell & Tanis, P.C.

(57) ABSTRACT

The invention relates to a sliding board, in particular a ski (1), with a running surface (2), steel edges(3), an upper shell (5), a core (6), and also with at least one interface element connected to the sliding board body by means of at least two anchoring elements (11), for example a guide element profiled in rail-like fashion, for arranging a binding element on the upper side of the sliding board, the anchoring elements (11) comprising anchoring parts (12, 12', 12'', 12''') which have been foamed in during manufacture of the sliding board.

In order to improve the integration of the anchoring elements (11) retained in the core (6) by hardening foam, the anchoring parts (12, 12', 12'', 12''') of the anchoring elements (11), which parts are retained in the foam, comprise portions or elements through which and/or, in relation to the upper side of the sliding board, over which the still liquid foam has flowed.

6 Claims, 2 Drawing Sheets

SLIDING BOARD, IN PARTICULAR SKI

FIELD OF THE INVENTION

The invention relates to a sliding board, in particular a ski, with a running surface, with steel edges, an upper shell, a core, and also with at least one interface element connected to the sliding board body by means of at least two anchoring elements, for example a guide element profiled in rail-like fashion, for arranging a binding element on the upper side of the sliding board, the anchoring elements comprising anchoring parts which have been foamed in during manufacture of the sliding board.

BACKGROUND OF THE INVENTION

From EP 1 161 972, a sliding board with a profiled rail system is known, which consists of at least one rail which extends in the longitudinal direction of the sliding board and is connected to the sliding board body by a dowel connection or dowel anchoring via at least one formed-on dowel or dowel portion. In one embodiment, for fastening the rail to the ski body, a number of pegs designed as expansion dowels, which are slotted and have a bore which narrows toward the free end of the peg and is open to the upper side of the rail, are formed on following one another in the longitudinal direction of the rail. After the rail has been attached to the ski body by inserting the pegs into bores provided correspondingly on the ski body, pins are driven into the bores, expanding the pegs. The profiled rails are consequently fastened to the finished sliding board and only replace the otherwise usual screw fastening. In order to provide a sliding board with a premounted profiled rail system, it is therefore necessary to carry out fastening and mounting operations on the finished sliding board.

SUMMARY OF THE INVENTION

An as yet unpublished international application discloses interface elements for arranging binding parts on the upper side of a sliding board, which have already been connected to the sliding board body during its manufacture by means of anchoring elements which are integrated into the core when it is foamed and are retained by the hardened foam. The anchoring elements are provided with indentations, grooves and the like, for example, in order to guarantee the retention of the interface elements in the ski body even under heavy loads.

The object of the invention is to improve the strength of the integration of anchoring elements retained in the core by foam.

According to the invention, the object set is achieved by virtue of the fact that the anchoring parts of the anchoring elements, which parts are retained by the hardening foam, comprise portions or elements through which and/or, in relation to the upper side of the sliding board, over which the still liquid foam has flowed.

Anchoring elements made according to the invention are therefore capable of guaranteeing, even under great loads, that the binding parts arranged on the ski or sliding board via the interface elements are retained firmly in the ski or sliding board.

According to a preferred embodiment of the invention, the anchoring part is made as a body which is round or oval, for example, or comprises such a body as a component. This is one of the possible embodiments which ensure that the anchoring parts of the anchoring elements, which parts are integrated in the hardened foam, offer marked resistance to forces acting perpendicularly or essentially perpendicularly to the upper side of the ski.

In another, at least just as favorable embodiment, the anchoring part is an annular or similar part or comprises such a part. According to another, particularly advantageous embodiment of the invention, the anchoring part is provided with at least one anchor-like or blade-like element.

BRIEF DESCRIPTION OF THE DRAWINGS

Further features, advantages and details of the invention are described in greater detail with reference to the drawing, which shows a few illustrative embodiments diagrammatically and in which.

DETAILED DESCRIPTION OF THE INVENTION

Figure 1:
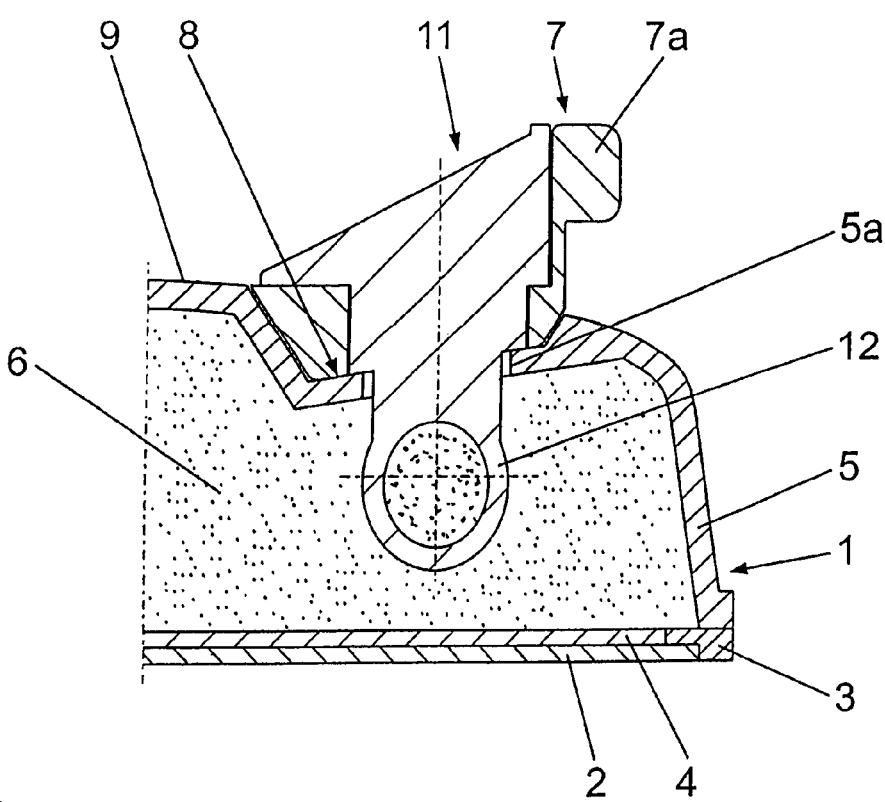
FIG. 1 to FIG. 4 show partial cross sections through a ski with anchoring elements with different variant embodiments of the invention.

The ski 1 illustrated in all the drawing figures comprises a running surface 2, steel edges 3, a lower web 4, an upper shell 5, which includes or forms the lateral sides of the ski and the upper side of the ski 1 and is made of one or more layers, and a foamed core 6. In the embodiment illustrated, the upper shell 5 of the ski 1 is provided with two depressions 8 extending in the longitudinal direction of the ski, in which guide elements 7 profiled in rail-like fashion for binding parts are positioned. A raised portion 9 is located between the two depressions 8. The guide elements 7 profiled in rail-like fashion form in pairs interface elements for attaching the binding parts to the ski 1, for example a toe-piece or a heel-holder of a safety binding. For this purpose, the guide elements 7 are each provided on their longitudinal portions facing the adjacent sides of the ski 1 with a guide strip 7*a*. Each guide element 7 profiled in rail-like fashion is provided with at least two anchoring elements 11, which effect the connection of the guide element 7 to the ski body. The anchoring elements 11 can be formed on the guide elements 7 profiled in rail-like fashion or can be separately manufactured components which are inserted from above into corresponding receiving locations of the guide elements 7 and retained there.

Other plies (not illustrated) which reinforce the ski structure, for example an upper web, can be incorporated between the upper shell 5 and the foamed material core 6. The core 6 of the ski is formed during ski manufacture by virtue of the interior of the ski constructed from the individual components being filled with foam, which hardens during the pressing operation while heat is supplied. During hardening of the foam, the anchoring elements 11 are connected firmly to the core 6. The anchoring elements 11 are put into prepunched holes 5*a* in the upper shell 5 during ski manufacture, by virtue of which the guide elements 7 profiled in rail-like fashion are also positioned during ski manufacture.

The variants of anchoring elements 11 shown in the individual drawing figures are especially suitable for retaining the guide elements 7 profiled in rail-like fashion in a firm connection to the ski 1 even under very high loads.

FIG. 1 shows an embodiment in which the part 12 of the anchoring element 11 anchored in the foam of the core 6 is essentially annular in cross section and through which the liquid foam can flow, as shown. In this connection, the ring can be oriented in any direction in relation to the plane of the running sole, an orientation which is as perpendicular as possible to the upper side of the ski being preferred. Elongate or oval shapes, in which the longer axis runs parallel to the running surface, are likewise very advantageous. An embodiment in which the ring has its largest diameter in its portion adjacent to the running surface 2 is preferred.

Figure 2:
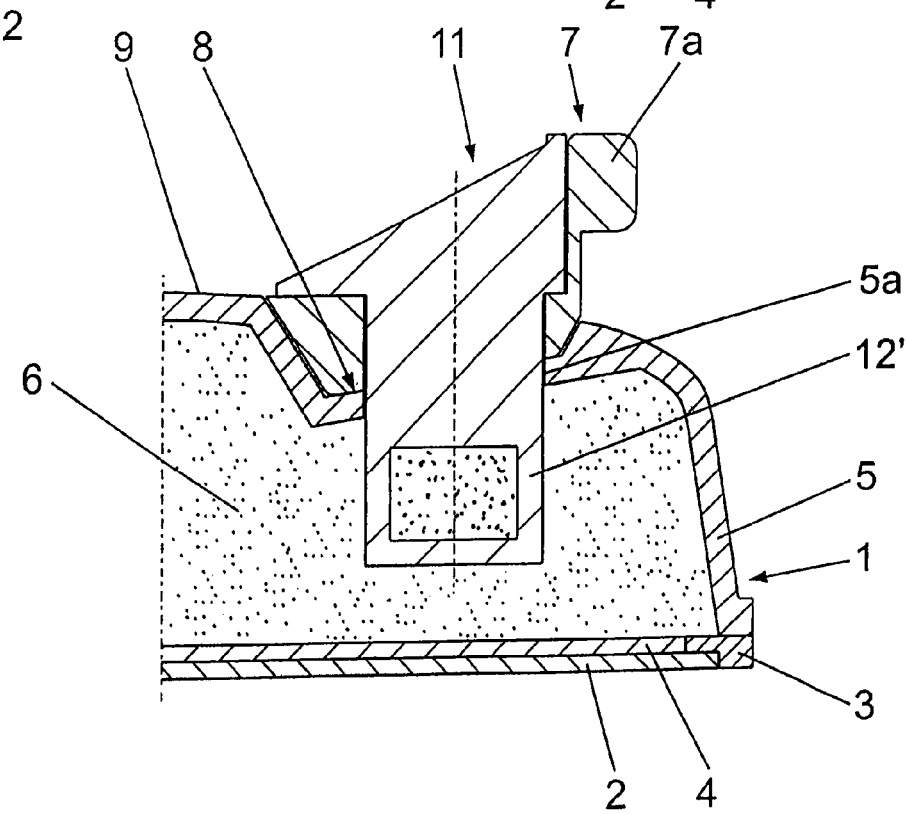

In the embodiment shown in FIG. 2, an anchoring part 12' which is approximately rectangular in cross section and surrounds a central cross-sectionally rectangular opening, through which the liquid foam can flow, is provided. Instead of the rectangular shape shown, a trapezoid shape can also be selected, in particular one in which the base is adjacent to the running surface 2. It is an advantage in this variant embodiment as well if those portions of the anchoring element 11' extending parallel or essentially parallel to the running surface 2 are made as wide as possible so as to offer great resistance to forces acting in a perpendicular direction.

Figure 3:
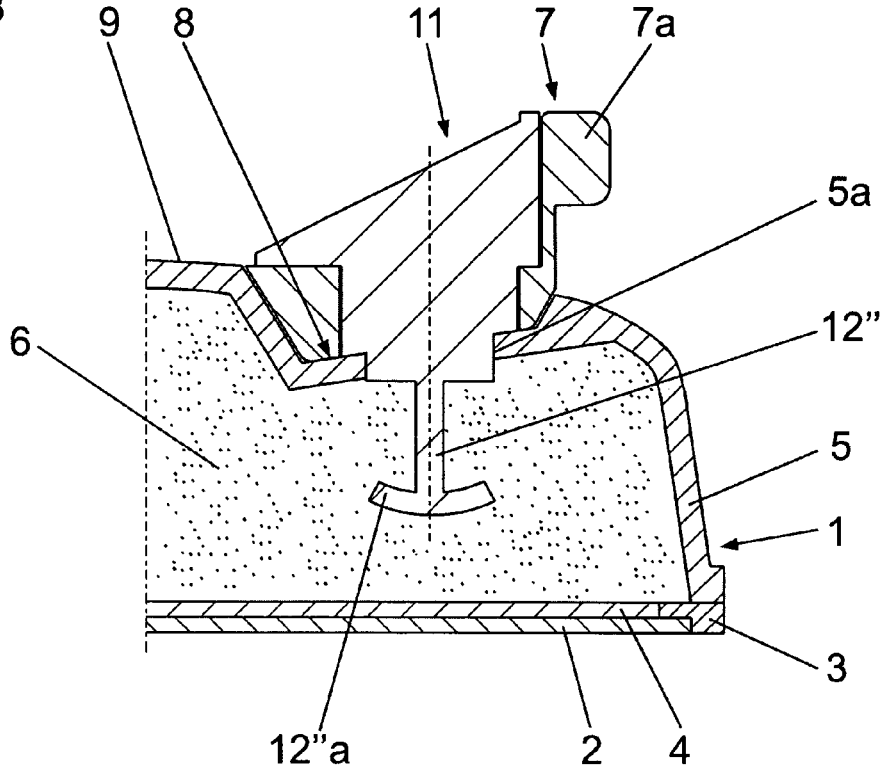

In the variant shown in FIG. 3, the anchoring part 12" of the anchoring element 11 illustrated is approximately anchor-shaped, the anchor blades 12"*a* extending approximately parallel to the running surface and being in particular of large-surface, projecting design.

Figure 4:
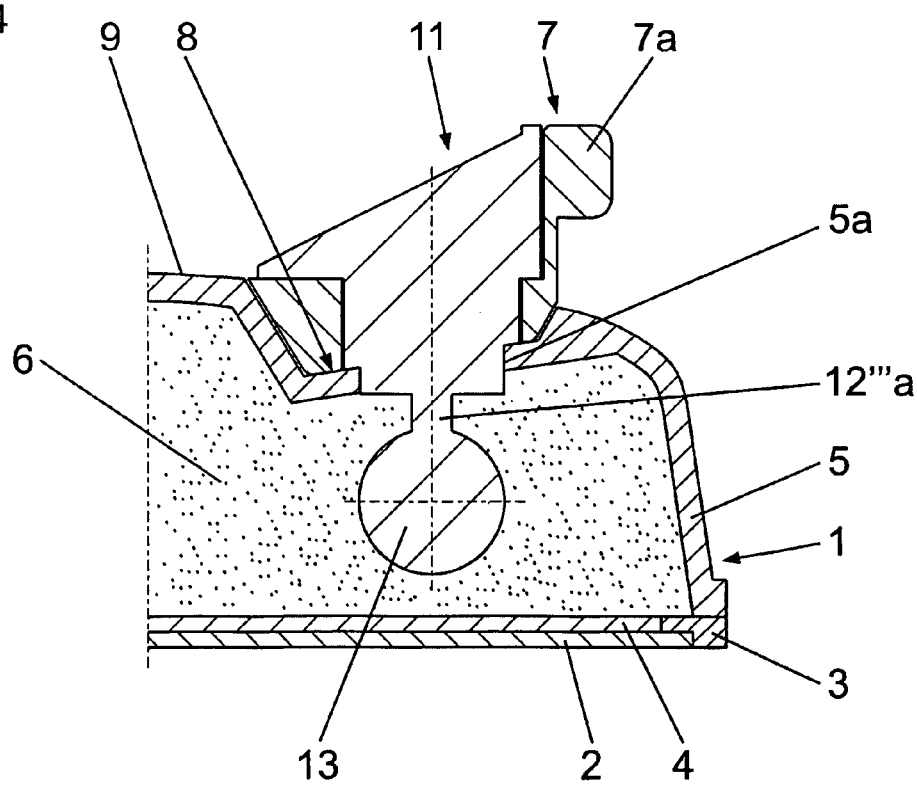

FIG. 4 shows a variant embodiment with an anchoring part 12'" consisting of a body 13 which is attached to a connecting part 12'"*a* and can be a ball or the like. It is important here as well that the body 13 has as large a surface as possible in a direction approximately perpendicular to the running surface or upper side of the ski and thus offers as great a resistance as possible.

Other variant embodiments (not illustrated) of anchoring elements are possible and are included by the invention. Mention may be made of, for example, an anchoring part with a disk oriented parallel to the running sole. In another embodiment (not illustrated), provision can also be made for foaming to be carried out around the anchoring elements within receiving locations in the form of recesses, depressions and the like in the core and for the elements to be fixed in the hardening foam in this way, but for the core otherwise to be made from another material, for example from wood, plastic or other materials. The receiving locations can be filled with foam via channels leading outward. The anchoring parts can also be separate parts to be connected to the heads of the anchoring elements.

The invention claimed is:

1. A sliding board, comprising a running surface, steel edges, an upper shell, a core, and at least one guide element connected to the sliding board by at least two anchoring elements, the guide element profiled in rail-like fashion, for arranging a binding element on the upper shell of the sliding board, said anchoring elements each comprising at least one anchoring part which has been foamed in during manufacture of the sliding board, wherein each said anchoring part is retained inside the sliding board by hardened foam and comprises at least one opening through which the hardened foam extends.

2. The sliding board as claimed in claim 1, wherein said anchoring parts comprise at least one body which is round or oval in cross section.

3. The sliding board as claimed in claim 1, wherein said anchoring parts comprise at least one cross-sectionally annular part.

4. The sliding board as claimed in claim 1, wherein the anchoring parts are provided with indentations, grooves, depressions, or openings.

5. The sliding board as claimed in claim 3, wherein said hardened foam extends through said cross-sectionally annular part.

6. The sliding board as claimed in claim 1, wherein said anchoring parts comprise at least one body which is rectangular in cross section.

* * * * *